United States Patent [19]

Giori

[11] Patent Number: 4,516,496

[45] Date of Patent: May 14, 1985

[54] COPPERPLATE ENGRAVING MACHINE FOR PRINTING PAPER CURRENCY

[75] Inventor: Gualtiero Giori, Lonay, Switzerland

[73] Assignee: De La Rue Giori S.A., Switzerland

[21] Appl. No.: 476,539

[22] Filed: Mar. 18, 1983

[30] Foreign Application Priority Data

Apr. 7, 1982 [CH] Switzerland ..... 2150/82

[51] Int. Cl.[3] ..... B41F 9/02

[52] U.S. Cl. ..... 101/152; 101/153; 101/175

[58] Field of Search ..... 101/150, 152, 153, 170, 101/175, 176

[56] References Cited

U.S. PATENT DOCUMENTS

| | | | |
|---|---|---|---|
| 1,052,473 | 2/1913 | Firm | 101/175 |
| 1,883,227 | 10/1932 | Wood | 101/176 |
| 2,733,656 | 2/1956 | Gottsching | 101/175 |
| 2,853,003 | 9/1958 | Kaldschmidt et al. | 101/152 |
| 3,316,838 | 5/1967 | Feuchin | 101/152 |
| 3,426,679 | 2/1969 | Rhines | 101/175 |
| 3,980,018 | 9/1976 | Ichikawa | 101/170 |
| 4,056,056 | 11/1977 | Giori | 101/175 |
| 4,441,423 | 4/1984 | Germann | 101/175 |

FOREIGN PATENT DOCUMENTS

| | | | |
|---|---|---|---|
| 641543 | 5/1962 | Canada | 101/152 |
| 1806262 | 6/1969 | Fed. Rep. of Germany | 101/152 |
| 1259111 | 3/1961 | France | 101/152 |
| 987102 | 3/1965 | United Kingdom | 101/152 |

*Primary Examiner*—William Pieprz

*Attorney, Agent, or Firm*—Kane, Dalsimer, Kane, Sullivan and Kurucz

[57] ABSTRACT

This direct plate printing or copperplate machine comprises a plate carrier cylinder with at least one engraved or etched plate provided with cuts corresponding to the elements of a main design and shallower, finer cuts corresponding to the elements of a safety background, an impression cylinder, an inking roller cooperating with an inking unit and being in direct contact with the plate for inking the cuts corresponding to the elements of the main design, a pre-wiping device and a wiping device, and an inking system for inking the cuts corresponding to the safety background in several colors. This inking system consists of a collector cylinder having a smooth resilient surface cooperating with the engraved or etched plate, this collector cylinder being located, in the direction of rotation of the plate cylinder, ahead of the inking roller and comprising at its outer periphery three color selector cylinders for different colors which comprise in turn relief areas corresponding to the colored areas of the safety background, an inking device being associated with each color selector cylinder. This machine assures a perfect register between the reliefs of the various color areas obtained on the color selector cylinders of hard material for producing for example banknotes printed completely according to the direct plate printing or copperplate method. Due to the presence of hard surface material on the color selector cylinder, there is no limit as to the fineness of the safety background elements.

1 Claim, 1 Drawing Figure

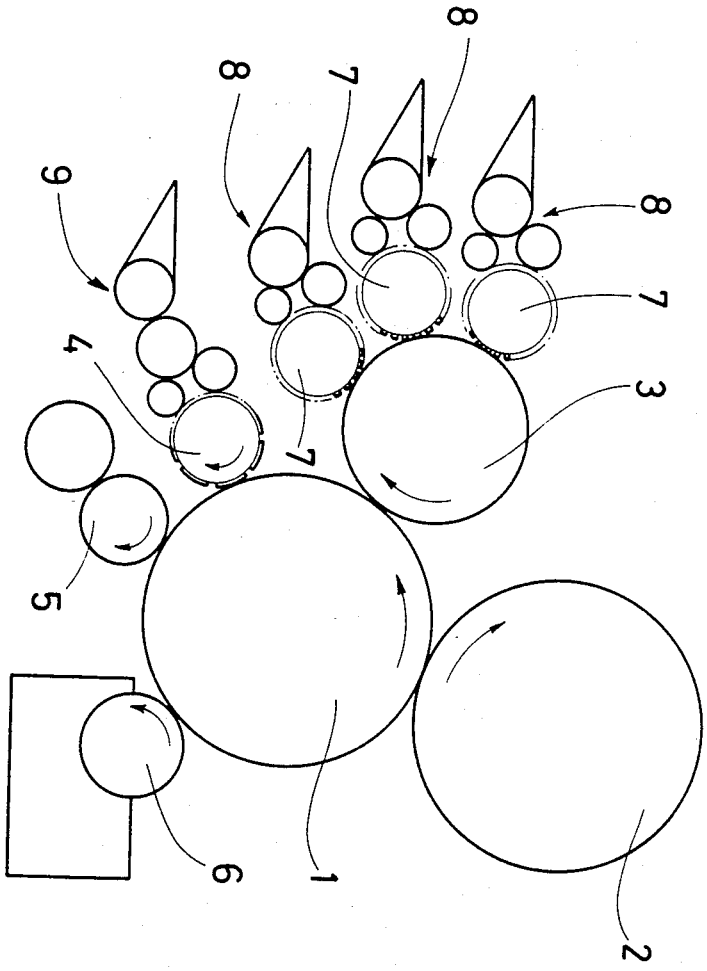
8
7
8
3
7
9
4
7
5
6
1
2

COPPERPLATE ENGRAVING MACHINE FOR PRINTING PAPER CURRENCY

BACKGROUND OF THE INVENTION

1. Field of the Invention

The present invention relates to copperplate machines for printing paper currency notably banknotes, in the form of sheets or reels.

This machine comprises in general a cylinder having secured thereto at least one engraved plate provided with cuts corresponding to the elements of the main drawing and other cuts of lesser depth and greater fineness corresponding to the elements of a so-called safety ground or foundation, an impression cylinder, at least one ink roller inked by an inking unit and cooperating directly with the plate for inking the cuts representing the elements of the main drawing, a device for wiping the plate and preferably another, so-called pre-wiping device together with another inking system for inking the cuts corresponding to the safety ground with several (at least two) colors.

2. The Prior Art

In order to improve the safety factor against the forging of paper currency of all kinds, manufacturers have been led to produce paper currency by using the copperplate technique exclusively, for it is much more difficult to forge paper currency printed only by copperplate method, therefore also the safety ground thereof.

For this reason the Applicants already proposed in their French Patent No. 1,595,894 a polychrome copperplate printing machine comprising one or a plurality of inking devices for inking deep cuts corresponding to the main drawing, and two or more inking devices for inking the fine or shallower cuts corresponding to the safety ground.

However, in this specific case the ground cut inking device comprises a stereotype revolving while in surface engagement with the printing plate and adjustably secured to a carrier roll to permit the accurate setting of a perfect register and the correction of said register. However, this machine which, theoretically, should permit of printing completely paper currency according to the copperplate method in a single pass, was extremely complicated due to the use of stereotypes which implies a heavy loss of time for properly registering them, an operation which can only be carried out manually, this further constituting a source of defects or inaccuracies.

On the other hand, since with the copperplate method the printing plate is etched to different depths (up to 200 or 250 microns), the selector inking roller must exert a relatively strong pressure against the surface of the printing plate so that all the cuts of variable depths be properly filled with ink and thus yield subsequently the desired printing tones of a same color, this constituting a unique feature characterizing the copperplate method.

Consequently, the ink roller to be pressed against the plate must be lined with a relatively soft and resilient material, such as rubber, plastic or the like, of about 60° Shore, for transferring the ink from the roller to the copperplate. Besides, this ink roller must be capable of transferring ink of a predetermined color only to well-defined areas of the surface or the etched plate. Therefore, in this case, a roller was used the surface of which was cut out according to the contours of the areas to be printed in the color concerned, and this surface comprised relief areas for receiving the ink. However, considering the relatively soft material lining this ink roller and the relatively high pressure to be exerted thereby against the copper plate for properly filling the deepest cuts, the fineness of the areas corresponding to the relief areas is rather limited. Though this restriction does not constitute a serious inconvenience as far as the main drawing is concerned, inasmuch as in general the color areas representing this main drawing are relatively extended, on the other hand it has prevented so far the use of these resilient ink rollers for prinring safety grounds because the roller areas in which very fine cuts are made are obviously liable to undergo a distortion as a consequence of the pressure exerted thereon, so that the final quality of the print is impaired. A safety ground or foundation worthy of this name must consist of very fine lines and even points, and it is for this reason that up to now it was impossible ot obtain such a safety ground by using a very finely cut ink roller.

To avoid this inconvenience, the Applicants already proposed in their French Patent No. 1,259,111 a polychrome printing machine comprising inter alia a plate carrier cylinder cooperating with a plurality of inking units equal in number to the colors to be printed, each inking unit comprising a plainsurfaced inking roller of resilient material cooperating with a selector cylinder provided with relief areas corresponding to those to be printed in the predetermined color.

However, the system disclosed in the above-mentioned French Patent did not permit of inking deep cuts formed in the plate portions constituting the main drawing of a banknote or other paper currency. It appeared that it was impossible to print in a single pass a paper currency having a deeply etched main drawing and fine etched polychrome safety grounds. Moreover, assembling the various inking rollers was a complicated operation, and obtaining a perfect register was an extremely difficult task.

SUMMARY OF THE INVENTION

It is the primary object of the present invention to provide an improved printing machine capable of avoiding the above-mentioned inconveniences by operating only according to the copperplate method and in a single pass for printing paper currency having a finely etched or engraved safety ground or foundation having at least two colors, in perfect register not only with each other but also with the deeply etched main drawing.

For this purpose, the machine according to the present invention is characterized by the fact that the device for inking the cuts corresponding to the safety ground elements is composed of a collector cylinder having a smooth resilient surface cooperating with the etched plate, this cylinder being located, in the direction of rotation, ahead of the ink roller and comprising at its periphery at least two cylinders for selecting different colors, said selector cylinders having relief areas corresponding to the colored areas of the safety ground, an inking device being associated with each color selecting cylinder.

The principal advantage characterizing this machine is that it warrants a perfect register between the cuttings of the different color areas obtained on the selector cylinders of hard material, said cuttings being obtained either by chemical etching or by laser action, and that the cylinder registers perfectly with the printing plate. Moreover, since a hard material is used for making the surface of the selector cylinder, no limit is set to the fineness of the safety ground elements. Thus, banknotes or other paper currencies can be printed completely according to the copperplate method, that is not only for the main drawing but also for the safety grounds. Due to the fineness of the safety ground, it is possible with this machine to obtain banknotes or any other fiduciary prints that are extremely difficult to forge.

With the machine of the present invention, it is possible to produce paper currency or banknotes on a large commercial scale at very high rates since all difficult registers are eliminated inasmuch as the selector rollers and the printing plate, when properly prepared and assembled, register automatically and perfectly with one another. Besides, the collector cylinder affords perfectly registering slight color superpositions.

THE DRAWING

The single FIGURE of the attached drawing illustrates diagrammatically the arrangement of a copperplate machine constituting a pratical application of the present invention, given by way of example.

DESCRIPTION OF THE PREFERRED EMBODIMENT

The machine illustrated in the drawing comprises a plate carrier cylinder 1 cooperating in a manner known per se with an impression cylinder 2. The direction of rotation of the various cylinders and rollers is shown by arrows in the FIGURE. The plate carrier cylinder 1 has fixed to its outer surface a plurality of etched plates (not shown) having engraved on their surfaces both the main drawing of the paper to be printed, which consists of relatively deep cuts having variable dimensions, and the safety grounds consisting of very fine cuts forming extremely fine lines, or even points, these cuts being shallower than those forming the main drawing.

Disposed around the outer periphery of this plate carrier cylinder 1, in the direction of rotation of the cylinder, are a smooth-surfaced collector cylinder 3 for transferring the color areas of the safety ground image to the cuts representing this safety ground; the mode of operation of this collector cylinder and its other characteristic features will be described presently. Next to this collector cylinder 3, in the direction of rotation of cylinder 1, is the conventional selector ink roller 4 having a resilient surface and provided with a one-color inking system 9, for inking the deep cuts corresponding to the main drawing; this ink roller 4 is sectioned or divided into several relief areas having contours corresponding exactly to those of the surfaces to be printed. This conventional ink roller 4 is followed by a pre-wiping device 5, then by a wiping device 6, both of a type known per se, for cleaning the planium (the smooth surface of the printing plate outside the engraved or etched cuts) and forcing the ink into the cuts.

As already mentioned in the foregoing, the collector cylinder 3 comprises a smooth surface and consists of, or is lined with, rubber or other suitable resilient material. At least two different colors for two areas of different colors are transferred to the surface of this collector cylinder 3 which, consequently, cooperates with a many selector cylinders 7 as there are different colors. In the form of embodiment illustrated, the collector cylinder 3 cooperates with three selector cylinders 7 having hard surfaces, for example surfaces lined with hardened rubber, plastic or the like, or metal, each selector cylinder 7 being divided into sections in order to comprise relief areas having contours corresponding exactly to the contours of the surfaces to be printed with the corresponding color. These relief areas are obtained through any known and suitable means, for example by chemical etching, laser cutting, or the like. Since the surface of the selector cylinders is hard, there are no limits set regarding the fineness of the design to be obtained. It is even possible to obtain a safety ground comprising not only very fine lines but also points, a feature unattainable up to now. In the FIGURE, the thickness or height of these relief areas is of course exaggerated.

Each selector cylinder 7 is associated in the known manner with an inking device 8 comprising the ink trough proper and the color ink pick-up and distributing rollers.

In the form of embodiment illustrated in the drawing, the ratio of the diameters of the selector ink roller, respectively of the selector cylinders 7, and of the collector cylinder 3 and plate carrier cylinder 1, is 1:2:3, and in this case, three plates disposed at regular intervals on the surface of the plate carrier cylinder 1 are provided.

Since the very fine cuts corresponding to the safety ground are very shallow, the pressure to be exerted thereagainst by the collector cylinder 3 must be lower than that exerted by the conventional ink roller 4 against the deeper cuts corresponding to the main drawing; therefore, though the surface of collector cylinder 3 is moderately resilient, no distortion of the smooth surface can take place, so that the drawing can be transferred in perfect register. Similarly, between the selector cylinders 7 and the collector cylinder 3 only a very moderate pressure, reduced in fact to a simple contact, is required, this safely preventing a distortion of the very fine areas cut in the surface of the selector cylinders.

In order to obtain this perfect register between the sectioned selector cylinders and the printing plate, the following procedure is adhered to: firstly, one of the still non-sectioned selector cylinders 7 is mounted on the machine; then, the printing plate is fitted on the plate carrier cylinder 1, inked and then wiped; its image is subsequently transferred by means of the collector cylinder 3 to the selector cylinder 7 so that the plate image remains printed on this still non-sectioned cylinder. The selector cylinder 7 is then removed from the machine and the plate image is utilized for cutting the surface through any suitable and known means. Thus, for example, the plate image may be used as a base for a photographic mounting if the cutting is obtained by photomechanical etching. If the cutting is obtained by using a laser, the plate image is used as a base for coordinates to be introduced into the laser machine so that the cutting follows exactly the drawing in register with the plate. Of course, the same operation is repeated for the other selector cylinders 7 representing the other colors.

What is claimed as new is:

1. An intaglio plate printing machine for printing paper currency, notably banknotes, compriing a plate cylinder with at least one engraved plate provided with deep intaglio cuts corresponding to elements of a main design, and less deep, finer intaglio cuts corresponding to the elements of a safety background, an impression cylinder cooperating with and contiguous to a surface of the plate cylinder, at least one selector inking roller of an inking unit having a resilient surface with relief cuts therein and cooperating directly with said plate for inking the cuts corresponding to the main design, a plate wiping system contiguous to a surface of the engraved plate together with an inking system for inking the cuts corresponding to the safety background with at least two different colors, wherein said inking system for inking the cuts corresponding to the safety background elements consists of a collector cylinder having a smooth resilient surface cooperating with the engraved plate, said collector cylinder being located, in the direction of rotation of the plate cylinder, ahead of said selector inking roller and being in contact at its periphery with at least two hard color selector cylinders for different colors of the safety background which are formed with relief areas corresponding to the respective colored areas of the safety background, and an inking supply device being associated with each color selector cylinder.

* * * * *